United States Patent [19]

Drori

[11] 4,002,296

[45] Jan. 11, 1977

[54] ROTARY SPRINKLER PARTICULARLY FOR USE WITH LOW-ENERGY WATER JETS

[76] Inventor: Mordeki Drori, 89 Zahal St., Kiron, Israel

[22] Filed: Feb. 17, 1976

[21] Appl. No.: 658,610

[30] Foreign Application Priority Data

Feb. 19, 1975 Israel ..... 46668

[52] U.S. Cl. ..... 239/230

[51] Int. Cl.[2] ..... B05B 3/02

[58] Field of Search ..... 239/230, 231, 233, DIG. 1

[56] References Cited

UNITED STATES PATENTS 3,043,522 7/1962 Ryerson ..... 239/230

3,204,873 9/1965 Senninger ..... 239/230

*Primary Examiner*—John J. Love
*Assistant Examiner*—Michael Mar
*Attorney, Agent, or Firm*—Benjamin J. Barish

[57] ABSTRACT

A rotary sprinkler particularly for use with low-energy water jets comprises an arrangement wherein the forward stroke of its oscillating arm is used to rotate the sprinkler head, the oscillating arm being returned to its normal position during the return stroke without applying sufficient force against the sprinkler head to rotate same.

4 Claims, 4 Drawing Figures

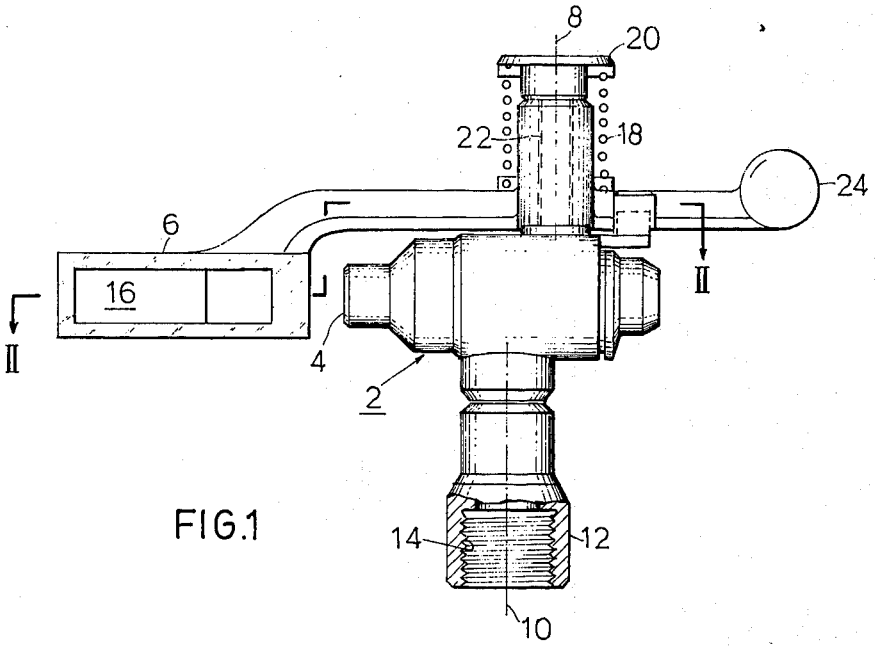
FIG.1
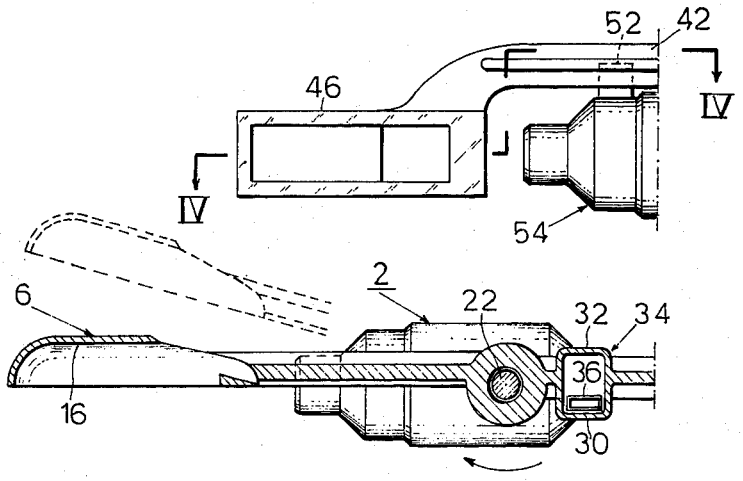
FIG.3
FIG.2
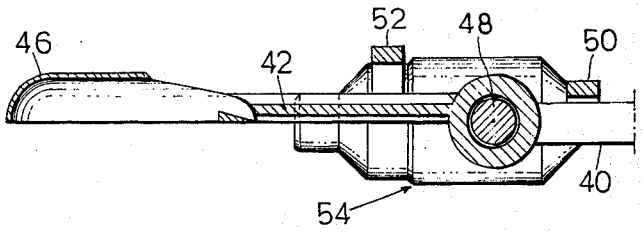
FIG.4

ROTARY SPRINKLER PARTICULARLY FOR USE WITH LOW-ENERGY WATER JETS

BACKGROUND OF THE INVENTION

The present invention relates to water sprinklers, and is particularly directed to sprinklers for use with low-energy water jets.

The conventional rotary sprinkler includes an oscillating arm which is impinged by the water jet to cause the arm to apply impacts against the sprinkler head and thereby to rotate the sprinkler about a vertical axis. There are many applications where only a small quantity of water is to be distributed by the rotary sprinkler, and therefore the energy available in the water jet is not always sufficient to rotate the sprinkler.

An object of the present invention is to provide a new rotary sprinkler which is particularly useful with respect to low-energy water jets, and which is constructed such that the low-energy in the water jet is sufficient to rotate the sprinkler

SUMMARY OF THE INVENTION

According to the present invention, there is provided a rotary sprinkler particularly for use with low-energy water jets, comprising: a sprinkler head, a mounting for the sprinkler head for mounting same on a pipe to rotate about a vertical axis, a nozzle carried by the sprinkler head through which the water is discharged in the form of a jet, and a pivotably mounted arm urged in one direction by a spring and driven by the water jet in the opposite direction, causing the arm to oscillate and to impact against the sprinkler head to rotate same about a vertical axis; characterized in that the sprinkler includes a pair of stops limiting all the oscillations of the arm; one of said stops being located to fix the normal position of the arm, as urged by said spring, in alignment with the water jet so as to be impinged and to be driven thereby; the other of said stops being located to permit the oscillating arm to be driven through a forward stroke, against the force of the spring, for a short distance to apply an impact against the sprinkler head and to rotate same about its vertical axis, said other stop being continuously located to permit the oscillating arm to pivot during said forward stroke only through a short arc of less than 20° before impacting against the sprinkler head, which short arc is sufficient to remove the oscillating arm from the path of the water jet but not sufficient to load the spring with enough energy to cause the arm to rotate the sprinkler head during the return stroke of the arm by the spring.

According to another feature of the described embodiment of the invention, the mounting of the sprinkler head is threaded such as to be self-tightening on the pipe when the sprinkler head is rotated by the impingement of the water jet against the oscillating arm during the forward stroke of the oscillating arm. This arrangement thus sharply distinguishes from the sector-type water sprinklers wherein the sprinkler is quickly returned to its normal position after being driven by the water jet through a predetermined arc, since in such conventional sector-type sprinklers the threading of the mounting is such as to be self-tightening when the sprinkler head is rotated during the return stroke of the oscillating arm under the force of the spring.

BRIEF DESCRIPTION OF THE DRAWINGS

The invention is herein described, by way of example only, with reference to two preferred embodiments illustrated in the accompanying drawings, wherein:

FIG. 1 is a side elevational view of one form of sprinkler constructed in accordance with the invention;

FIG. 2 is a sectional view along lines II — II of FIG. 1, showing the normal position of the oscillating arm in full lines, and its moved position in broken lines; and FIGS. 3 and 4 are views similar to those of FIGS. 1 and 2, respectively, of another embodiment of the invention.

DESCRIPTION OF THE PREFERRED EMBODIMENT

The rotary sprinkler illustrated in FIGS. 1 and 2 comprises a sprinkler head, generally designated 2, provided with a nozzle 4 through which the water issues in the form of a jet. An oscillating arm 6 is pivotably mounted about an axis 8 so as to be impinged by the water jet, and to apply an impact against the sprinkler head 2 to cause same to rotate about its vertical axis 10. The sprinkler is mounted on a vertical pipe (not shown) by a collar 12 formed with internal threads 14 adapted to mate with external threads formed on the pipe. The oscillating arm 6 is driven in one direction by the water jet issuing from nozzle 4 impinging against a surface 16 of the arm, and is returned to its normal position by a coil spring 18 fastened at one end (its lower end) to the oscillating arm 6, and fastened at its opposite end to a collar 20 fixed to a pin 22 carried by the sprinkler head 2 and about which arm 6 pivots during its oscillation by the water jet in one direction, and by spring 18 in the opposite direction. If desired, a weight 24 may be attached to the end of the oscillating arm 6.

In the normal rotary sprinkler of this type, the impingement of the water jet against the oscillating arm 6 causes the arm to pivot a predetermined arc (usually about 90°) to load spring 18, the spring then returning the arm to its normal position in alignment with the water jet; and upon its return to this normal position, it impacts an abutment carried by the sprinkler head to cause the sprinkler head to be rotated about its vertical axis 10. In other words, in the conventional rotary sprinkler the forward stroke of the oscillating arm is used to load spring 18, and the energy stored in that spring is used to rotate the sprinkler head during the return stroke of the oscillating arm.

In the rotary sprinkler of the present invention, however, this operation is reversed. In other words, in the rotary sprinkler of the present invention the forward stroke of the oscillating arm is used to rotate the sprinkler head, the oscillating arm being returned to its normal position during the return stroke without applying sufficient force against the sprinkler head to rotate same. Thus, threads 14 would be formed so as to be self-tightening when the sprinkler head is rotated by the impingement of the water jet against the oscillating arm during its forward stroke. It has been found that such sprinklers can be used even with low-energy water jets, the energy being sufficient to rotate the sprinkler.

In the embodiment of the invention illustrated in FIGS. 1 and 2, the two stops are constituted by a pair of spaced elements 30, 32 (FIG. 2) carried by the oscillating arm 6 on the same side as its pivotal axis 8, namely the axis of its pivotal pin 22. These stops 30, 32 are conveniently formed as the opposed walls of a rectangular section 34 formed on that end of the oscillating arm, and cooperate with an abutment member 36 carried by the sprinkler head 2.

Thus, as shown in full lines in FIG. 2, stop 30 normally engages abutment 36 so as to position the oscillating arm 6 in the path of the water jet. As the water jet impinges face 16 of the arm, this causes the arm to be pivoted to the broken line position illustrated in FIG. 2 until stop 32 engages abutment 36. When stop 32 engages abutment 36, the force applied to arm 6 by the water jet is transferred via abutment 36 to sprinkler head 2, causing the sprinkler head to rotate in the clockwise direction about its vertical axis 10. The sprinkler head is thus rotated during the forward stroke of the oscillating arm. During this forward stroke of the sprinkler head, spring 18 is loaded, but stop 32 limits the pivotal movement of the oscillating arm to a short arc, less than 20° (as compared to about 90° in the conventional sprinkler), sufficient only to remove the arm from the path of the water jet, but not sufficient to transfer enough energy to spring 18 so that the oscillating arm tends to rotate the sprinkler, during its return stroke, back to its normal position.

As indicated above, threads 14 are formed on the mounting 12 of sprinkler head 2 in such direction so as to be self-tightening on the pipe to which it is mounted when the sprinkler head is rotated furing the forward stroke of the oscillating arm (in the clockwise direction as shown in FIG. 2). This distinguishes in two respects from the conventional sector-type sprinkler: first, in the conventional sprinkler the stop which causes the sprinkler head to return after traversing a predetermined sector is not continuously located in the path to be engaged by the oscillating arm, as in the present case, but only is so positioned when the arm has traversed the predetermined sector; also, when such stop is active in the conventional sprinkler, the stop causes the sprinkler head to be rotated in the direction wherein its threads are not self-tightening, since the normal direction of rotation of the sprinkler is opposite.

FIGS. 3 and 4 illustrate a further embodiment wherein the two stops, which limit the oscillation of the arm to a predetermined short arc, are constituted by a pair of elements 40, 42 on opposite sides of the pivotal axis 48 of the oscillating arm 46, rather than on the same side of that axis as in the embodiments of FIGS. 1 and 2. In addition, these elements are engageable with a pair of abutments 50, 52 carried by the sprinkler head 54 on opposite sides of the arm pivotal axis 48, and are also engageable with elements 40 and 42 carried by the oscillating arm. The operation of the rotary sprinkler of FIGS. 3 and 4 is otherwise the same as that of FIGS. 1 and 2.

What is claimed is:

1. A rotary sprinkler particularly for use with low energy water jets, comprising: a sprinkler head, a mounting for the sprinkler head for mounting same on a pipe to rotate about a vertical axis, a nozzle carried by the sprinkler head through which the water is discharged in the form of a jet, and a pivotably mounted arm urged in one direction by a spring and driven by the water jet in the opposite direction, causing the arm to oscillate and to impact against the sprinkler head to rotate same about a vertical axis; characterized in that the sprinkler includes a pair of stops limiting all the oscillations of the arm; one of said stops being located to fix the normal position of the arm, as urged by said spring, in alignment with the water jet so as to be impinged and to be driven thereby; the other of said stops being located to permit the oscillating arm to be driven through a forward stroke, against the force of the spring, for a short distance to apply an impact against the sprinkler head and to rotate same about its vertical axis, said other stop being continuously located to permit the oscillating arm to pivot during said forward stroke only through a short arc of less than 20° before impacting against the sprinkler head, which short arc is sufficient to remove the oscillating arm from the path of the water jet, but not sufficient to load the spring with enough energy to cause the arm to rotate the sprinkler head during the return stroke of the arm by the spring.

2. A rotary sprinkler according to claim 1, wherein said mounting is threaded such as to be self-tightening on the pipe when the sprinkler head is rotated by the impingement of the water jet against the oscillating arm during the forward stroke of the oscillating arm.

3. A rotary sprinkler according to claim 1, wherein said two stops are constituted of a pair of spaced elements carried by the oscillating arm on the same side of the arm pivotal axis and disposed on opposite sides of an abutment member carried by the sprinkler head.

4. A rotary sprinkler according to claim 1, wherein said two stops are constituted by a pair of elements carried by the oscillating arm on opposite sides of the arm pivotal axis and engageable with a pair of abutment members carried by the sprinkler head also on opposite sides of the arm pivotal axis.

* * * * *